US008403067B2

(12) United States Patent
Knobloch, Jr. et al.

(10) Patent No.: US 8,403,067 B2
(45) Date of Patent: Mar. 26, 2013

(54) REPEATABLE, COMPRESSION SET DOWNHOLE BYPASS VALVE

(75) Inventors: Benton T. Knobloch, Jr., Broussard, LA (US); Todd J. Roy, Youngsville, LA (US); David J. Tilley, Franklin, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 250 days.

(21) Appl. No.: 12/856,252

(22) Filed: Aug. 13, 2010

(65) Prior Publication Data

US 2011/0083857 A1 Apr. 14, 2011

Related U.S. Application Data

(60) Provisional application No. 61/233,646, filed on Aug. 13, 2009.

(51) Int. Cl.
*E21B 34/10* (2006.01)

(52) U.S. Cl. ..... 166/386; 166/334.4

(58) Field of Classification Search ..... 166/373, 166/386, 332.2, 334.4
See application file for complete search history.

(56) References Cited

U.S. PATENT DOCUMENTS

| | | | | |
|---|---|---|---|---|
| 2,616,502 | A | | 11/1952 | Lenz |
| 3,280,917 | A | * | 10/1966 | Kisling, III ..... 166/150 |
| 4,074,761 | A | | 2/1978 | Mott |
| 4,315,542 | A | | 2/1982 | Dockins, Jr. |
| 4,365,671 | A | | 12/1982 | Long |
| 4,531,891 | A | | 7/1985 | Coles, III |
| 5,048,611 | A | | 9/1991 | Cochran |
| 5,176,216 | A | | 1/1993 | Slater et al. |
| 6,065,541 | A | | 5/2000 | Allen |
| 6,102,060 | A | | 8/2000 | Howlett et al. |
| 6,152,228 | A | | 11/2000 | Carmichael |
| 6,220,357 | B1 | | 4/2001 | Carmichael et al. |
| 6,227,291 | B1 | | 5/2001 | Carmichael et al. |
| 6,253,861 | B1 | | 7/2001 | Carmichael et al. |
| 6,279,657 | B1 | | 8/2001 | Carmichael et al. |
| 6,343,648 | B1 | | 2/2002 | Carmichael et al. |
| 6,655,462 | B1 | | 12/2003 | Carmichael et al. |
| 6,877,566 | B2 | | 4/2005 | Selinger et al. |
| 7,096,950 | B2 | | 8/2006 | Howlett et al. |
| 7,108,083 | B2 | | 9/2006 | Simonds et al. |
| 7,150,326 | B2 | | 12/2006 | Bishop et al. |
| 7,311,141 | B2 | | 12/2007 | Tulloch et al. |

(Continued)

FOREIGN PATENT DOCUMENTS

| | | |
|---|---|---|
| EP | 0692610 A2 | 1/1996 |
| GB | 2272923 A | 6/1994 |

(Continued)

OTHER PUBLICATIONS

PCT International Search Report, PCT/US2010/045456, issued Mar. 31, 2011.

(Continued)

*Primary Examiner* — William P Neuder
(74) *Attorney, Agent, or Firm* — Booth Albanesi Schroeder LLC

(57) ABSTRACT

A bypass valve for use in tubing string which can be repeatedly opened and closed to selectively provide bypass fluid flow between the interior of the tubing string and the annulus to assist in flowing debris. The valve uses hardened valve elements which can be opened and closed while flowing fluids under pressure through the tubing string. The valve is actuated by placing the tubing string in a sufficient weight down condition to operate the valve. A trigger is provided to prevent unintended actuation of the bypass valve during use.

21 Claims, 5 Drawing Sheets

U.S. PATENT DOCUMENTS

| | | | | |
|---|---|---|---|---|
| 7,318,478 | B2 | 1/2008 | Royer | |
| 7,347,288 | B2 | 3/2008 | Lee | |
| 7,383,881 | B2 | 6/2008 | Telfer | |
| 7,500,526 | B2 | 3/2009 | Telfer | |
| 7,520,333 | B2 * | 4/2009 | Turner et al. | 166/375 |
| 7,637,323 | B2 | 12/2009 | Schasteen et al. | |
| 2005/0072572 | A1 * | 4/2005 | Churchill | 166/319 |
| 2006/0225885 | A1 * | 10/2006 | Mcgarian et al. | 166/334.4 |
| 2009/0056952 | A1 | 3/2009 | Churchill | |
| 2010/0252276 | A1 | 10/2010 | Clausen et al. | |
| 2011/0011588 | A1 | 1/2011 | Melder et al. | |
| 2011/0048723 | A1 | 3/2011 | Edwards | |

FOREIGN PATENT DOCUMENTS

| | | | |
|---|---|---|---|
| GB | 2309470 | A | 7/1997 |
| GB | 2323111 | A | 9/1998 |
| GB | 2325682 | A | 12/1998 |
| GB | 2339814 | B | 8/2002 |
| GB | 2341405 | B | 9/2002 |
| GB | 2342666 | B | 1/2003 |
| WO | 03089755 | A1 | 10/2003 |
| WO | 2008139132 | A1 | 11/2008 |
| WO | 2011028558 | A2 | 3/2011 |
| WO | 2011028563 | A2 | 3/2011 |

OTHER PUBLICATIONS

MI SWACO, 2008 Catalog Specialized Tools, 2008, pp. 1-59, M-I L.L.C., Houston, Texas.

*M-I, LLC* v. *Chad Lee Stelly, et al.*, In the United States District Court for the Southern District of Texas, Houston Division, C.A. No. 4:09-CV-01552, Third Amended Complaint (Exhibits A-G were designated Attorney Eyes Only at time of filing and have been removed), Sep. 7, 2010.

*M-I, LLC* v. *Chad Lee Stelly, et al.*, In the United States District Court for the Southern District of Texas, Houston Division, C.A. No. 4:09-CV-01552, Answer and Counterclaims to Plaintiff's Third Amended Complaint, Jan. 28, 2011.

*M-I, LLC* v. *Chad Lee Stelly, et al.*, In the United States District Court for the Southern District of Texas, Houston Division, C.A. No. 4:09-CV-01552, Order of Dismissal with Prejudice, Jun. 28, 2012.

* cited by examiner

REPEATABLE, COMPRESSION SET DOWNHOLE BYPASS VALVE

CROSS REFERENCE TO RELATED APPLICATIONS

This application claims priority from U.S. Provisional Patent Application No. 61/233,646 filed Aug. 13, 2009 entitled "REPEATABLE, COMPRESSION SET DOWNHOLE BYPASS VALVE," which is hereby incorporated by reference in its entirety.

BACKGROUND

1. Technical Field

These inventions relate, generally, to apparatus and methods used in well servicing, such as oil and gas wells. More specifically, the inventions relate to downhole apparatus which when assembled in a tubing string can repeatedly and selectively create a fluid bypass in the circulating system of a well being serviced.

2. Background Art

As is known in the relevant art, bypass tools are typically run into wellbores assembled or connected in a tubular string and are utilized to selectively discharge fluids from the interior of the tubing string into the annular space around the tool. In some applications, this discharge is used to boost or assist the flow of debris in the annulus.

As used herein, the words "comprise," "have," "include," and all grammatical variations thereof are each intended to have an open, non-limiting meaning that do not exclude additional elements or steps. The term "wellbore" refers to the subterranean well opening, including cased and uncased. The term "tubing string" is used generically to refer to tubular members positioned in a wellbore, such as drill pipe, tubing and the like. The term "well fluids" refers broadly to any fluids found in a wellbore. As used in this application, the term "bypass" refers to a fluid flow path from the bore or interior of a tubing string into the wellbore/tubing string annulus, at some point along the length of the tubing string, rather than out the lower most end of the tubing string and downhole assembly. It is understood that even in a bypass mode, some fluid may still traverse the length of the tubing string and exit the lowermost end thereof. As used herein, "weight down" is used to describe a condition of the tubing string where at least a portion of the weight of the tubing string is supported downhole in compression rather than tension. As used herein, the term "poppet valve" is used to refer to a valve operated by springs or the like that plugs and unplugs its openings by axial movement.

SUMMARY OF THE INVENTIONS

The present inventions provide a tool with a tubular body for assembly in a tubing string which can be selectively activated to provide bypass flow. The tool preferably includes a body with one or more ports or passageways connecting the interior of the tubing string with the annulus. The tool includes metallic, ball-shaped valves and metallic seats. The ball-shaped valves can be cycled or moved into and out of positions blocking or permitting bypass flow through the passageways even when the fluid are being pumped through the tool under pressure. In other words, it is not required to shut down fluid circulation when activating the tool. In addition, the tubing string can be rotated and axially cycled while the tool is in the bypass flow position.

BRIEF DESCRIPTION OF THE DRAWINGS

The drawings are incorporated into and form a part of the specification to illustrate at least one embodiment and example of the present inventions. Together with the written description, the drawings serve to explain the principles of the inventions. The drawings are only for the purpose of illustrating at least one preferred example of at least one embodiment of the inventions and are not to be construed as limiting the inventions to only the illustrated and described example or examples. The various advantages and features of the various embodiments of the present inventions will be apparent from a consideration of the drawings in which.

DETAILED DESCRIPTION OF THE INVENTIONS

Figure 1:
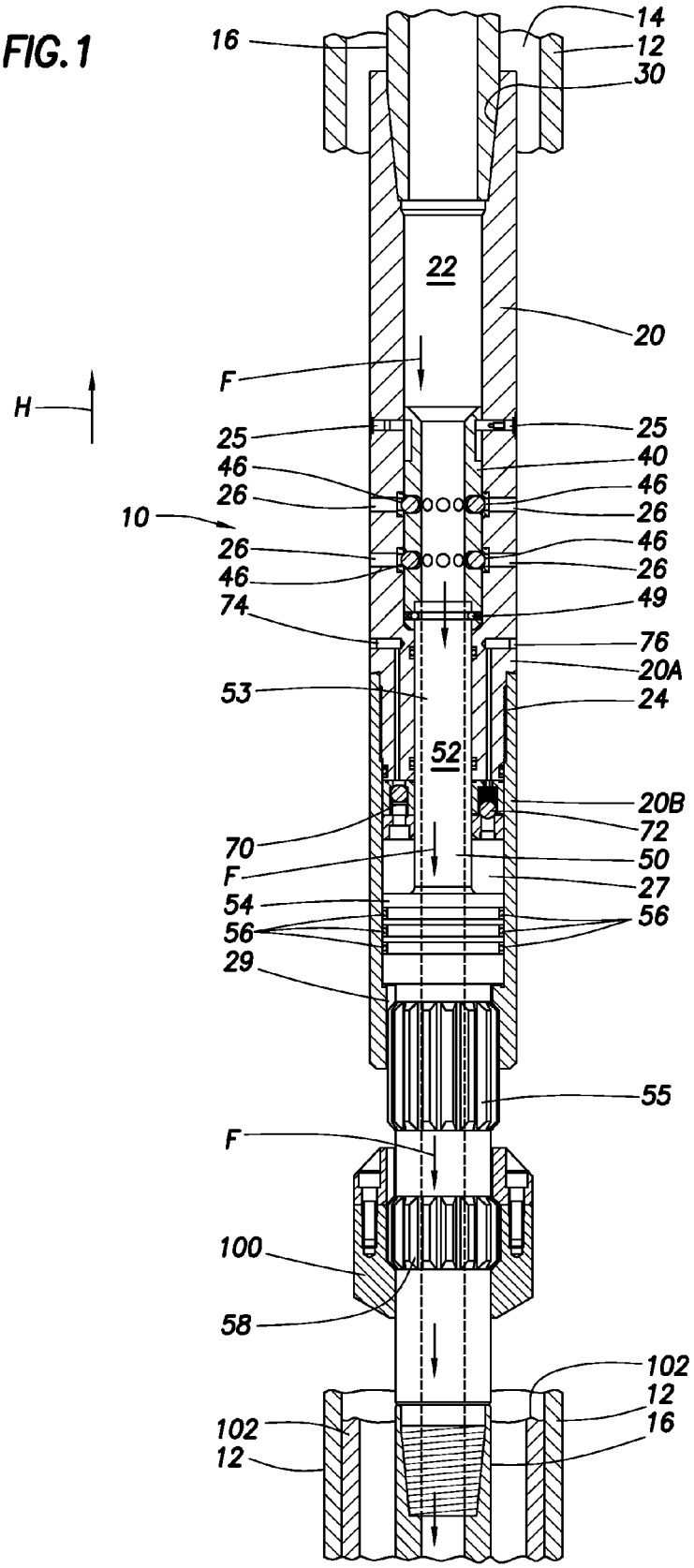
FIG. 1 is a partial section view of the bypass valve of the present inventions illustrated in a closed position.

Referring now to the drawings, wherein like reference characters refer to like or corresponding parts throughout the several figures, there is illustrated in FIG. 1, compression set bypass valve 10 positioned in a wellbore 12, forming an annulus 14 around the tool inside the wellbore. Typically, the wellbore 12 contains well fluids, such as drilling mud, debris such as cuttings and the like and can be cased (as illustrated) or uncased. In FIG. 1, the arrow "H" references the uphole or well head direction, without regard to the actual physical orientation of the wellbore. The bypass valve 10 has an elongated tubular shape comprising a main body 20 with means thereon, typically threaded connections 30 and 57, for connecting the tool in a tubing string 16. In the illustrated embodiment, the bypass valve 10 is connected in a tubing string. In this embodiment, the tubing string 16 is a drill string and the bypass valve 10 is connected in the tubing string between the well head and the drill bit or clean out tool (not shown).

A central passageway or bore 22 extends the length of the bypass valve 10, as shown, and when assembled in a tubing string the passageway is in fluid communication with the interior of the string as indicated by arrows F. Main body 20 may be made in two body sections 20A and 20B, joined by a threaded connection 24. Two axially spaced sets of ports 26 extend through the wall of the upper body section 20A. In this embodiment, each set comprises a plurality of ports, in this example, four ports are circumferentially spaced at 90 degree intervals. Also, in this embodiment only two sets of ports are illustrated, however it should be understood that, depending on the valve diameter and bypass flow requirements, more or less sets could be present. As will be described, these ports 26, when open, provide bypass flow from the bore 22 of the bypass valve 10 to the annulus 14.

Figure 4:
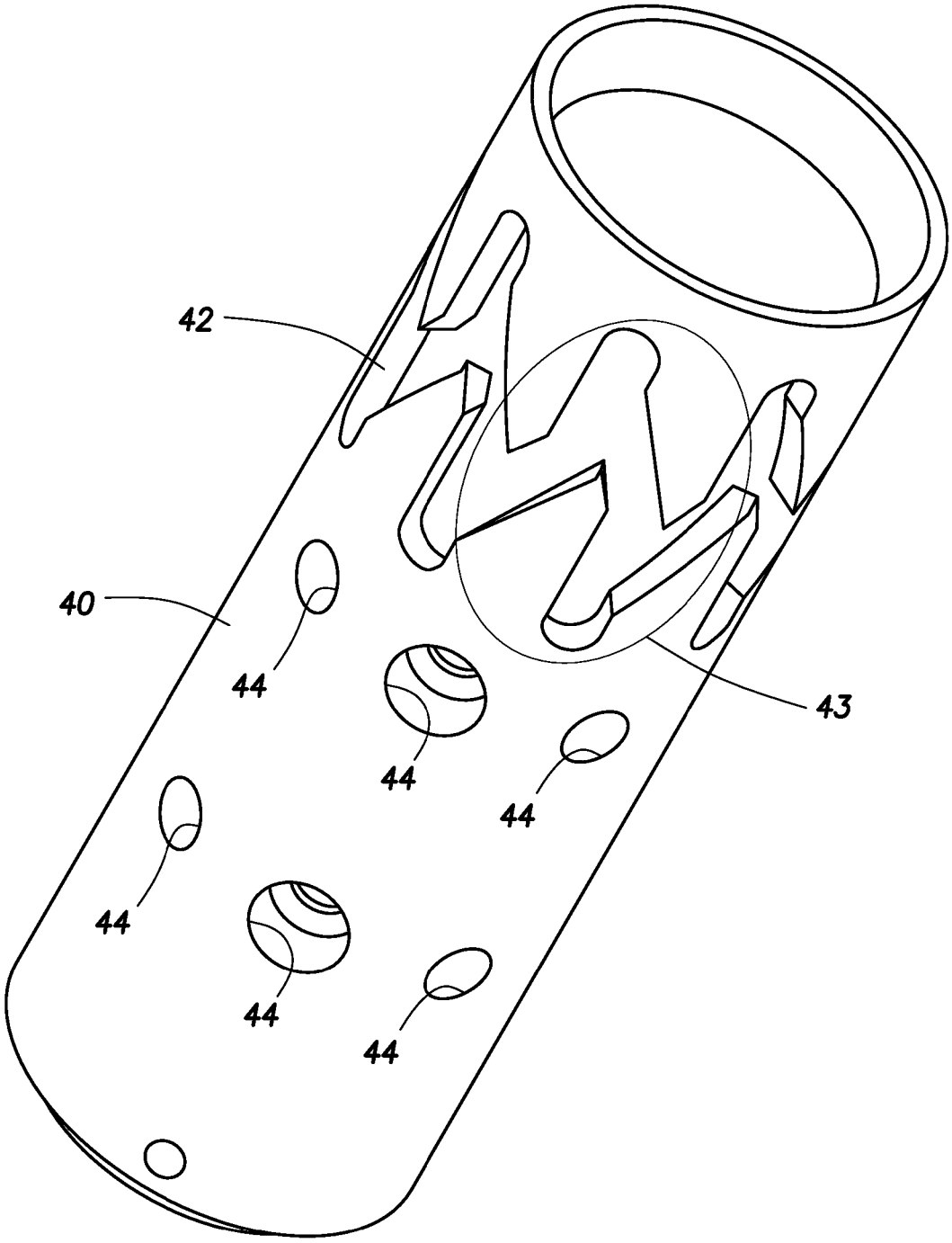
FIG. 4 is an enlarged perspective view of the spool element of the bypass valve of the present inventions.

A generally cylindrical spool 40 is disposed within bore 22 of main body 20 for rotational and axial movement therein. The term "spool" is not intended to be limited to a particular shape. The spool 40 is located adjacent the ports 26. FIG. 4 illustrates additional details of spool 40. Spool 40 comprises a continuous indexer slot 42 formed in the outer wall of the spool. In this embodiment, the indexer slot 42 contains eight notch configurations 43 spaced 45 degrees apart. The function of indexer slot 42 is described in more detail later.

Spool 40 is held within bore 22 by one or more index pins 25 mounted to extend through the wall of main body 20 so as to protrude into indexer slot 42. It is understood that spool 40 may move axially and rotate as the index pins 25 ride or are confined in the indexer slot 42. It is to be understood that the positions of the pin and slot could be reversed, with the slot formed on the interior of the body and the pin mounted on the body. Spool 40 further comprises a plurality of openings or ports 44 through the wall of the spool 40. As shown, the spool of the illustrated embodiment has two axially spaced sets of eight ports 44. These ports 44 are circumferentially spaced 45 degrees apart. The axial spacing of these sets of ports 44 correspond to the axial spacing of the sets of ports 26 in the upper section 26*a*. Balls 46, preferably of hard metal such as carbon chrome, are mounted in enlarged (counter-bored) alternate ports 44. When fluid pressure or flow is present inside the spool 40, the balls 46 move outwardly so as to seal the flow path through ports 44 and 26 These counterbores form pockets for loosely retaining the balls. Ports 44 are spaced and mounted to align with ports 26 in upper body section 20*a*. When spool 40 is in one position (with the index pins 25 resting in one notch configuration 43), balls 46 are aligned with ports 26, and when so aligned, balls 46 are moved outwardly by fluid pressure/flow so as to seal the ports 26 and prevent any fluid flow through ports 44 and 26. When spool 40 is in the adjacent position (with the pins 25 located in the adjacent notch configuration 43), namely rotated one "notch," then open ports 44 (that is, without balls 46 therein) are aligned with ports 26, and the bypass is thereby open and fluid may flow from bore 22 into the annulus 14, thereby affecting the bypass. The method of moving the spool 40 from between the notch configurations 43 will be described hereinafter. It is understood that the alternate ports 44 and balls 46 could be eliminated, allowing the spool to act as a valve element.

The bypass valve 10 also comprises a mandrel 50 disposed within main body 20. As illustrated in the drawings, mandrel 50 comprises a longitudinal bore 52. A reduced or smaller diameter upper mandrel section 53 extends upwardly into bore 22 of main body 20 and is connected to the spool 40 at 49. A lower, larger diameter plunger section 54 is sized to fit snugly within a chamber 27 formed within the lower body section 20B of the main body 20. Preferably, external splines 55 engage internal splines 29 formed in chamber 27 of the lower body section 20A. The interaction or meshing of the splines serves to rotationally lock mandrel 50 in the main body 20 while permitting and telescoping movement. Plunger section 54 further comprises seals 56 to provide a fluid seal with the walls of chamber 27. The lower end of mandrel 50 preferably has a means for connecting the mandrel to a drill string, such as threaded connection 57. Mandrel 50 may also be provided with a second set of external splines 58, which serve as a mounting base for an enlarged diameter member such as a stabilizer or landing ring 100.

Figure 5:
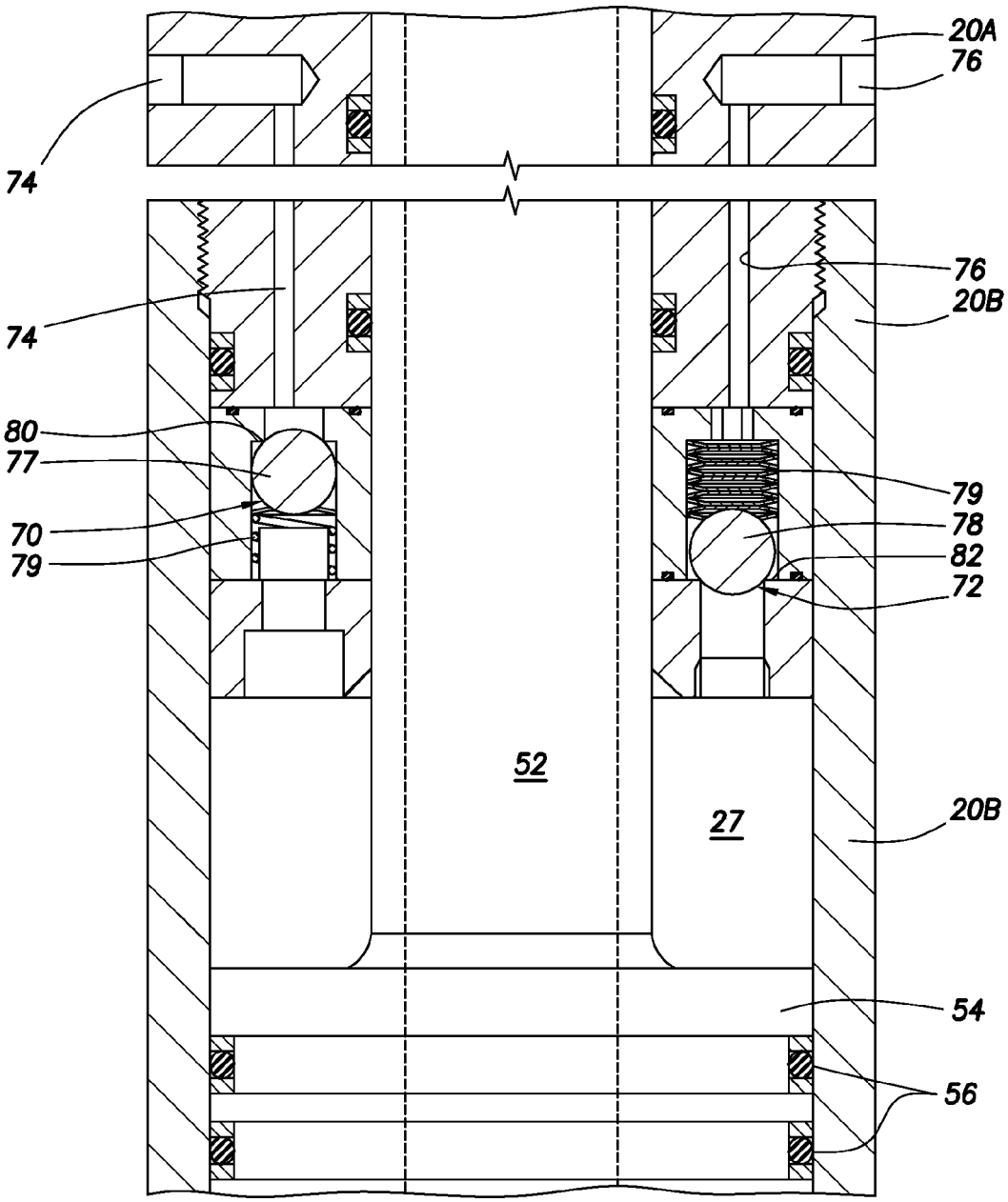
FIG. 5 is an enlarged sectional view of the check valve portion of the tool of the present inventions.

Bypass valve 10 further comprises a check valve system which controls fluid flow into and out of the chamber 27. As will be explained, the check valve system operates as a mechanical trigger which can be preset to prevent telescoping of the mandrel with the body unless a set telescoping force is applied. FIG. 5 shows greater detail of the check valve system. The check valve system comprises a plurality of one way or check valves, such as poppet valves 70 and 72 controlling the flow respectively through with fluid passage 74 and 76. One of the valves, for example poppet valve 70, controls fluid flow through fluid passage 74 and into chamber 27 (but does not permit flow out of the chamber). The poppet valve 72 control fluid flow through fluid passages 76 and out of chamber 27 (but does not permit flow into the chamber). While only two poppet valves 70 and 72 are shown for simplicity, it is to be understood that bypass valve 10 may comprise a greater number of poppet valves, such as two valves controlling fluid flow into chamber 27 and two valves controlling fluid flow out of chamber 27.

In the illustrated embodiment, the poppet valves 70 and 72 comprise balls 77 and 78, respectively, which act as valve elements. So as to affect the fluid seal, springs 79 resiliently urge the balls 77 and 78 against seats 80 and 82, respectively. Springs or other biasing elements can be selected, as desired, to control the pressure required to open the valves for fluid entry/exit. The springs are selected to apply sufficient force to the balls to prevent friction or drag on the tubing string and landing ring 100 during insertion in the well from causing poppet valve 72 to opening. On the other hand, the springs are selected so that poppet valve 72 will open and discharge fluid from chamber 27 when the string is in the weight down condition.

Figure 2:
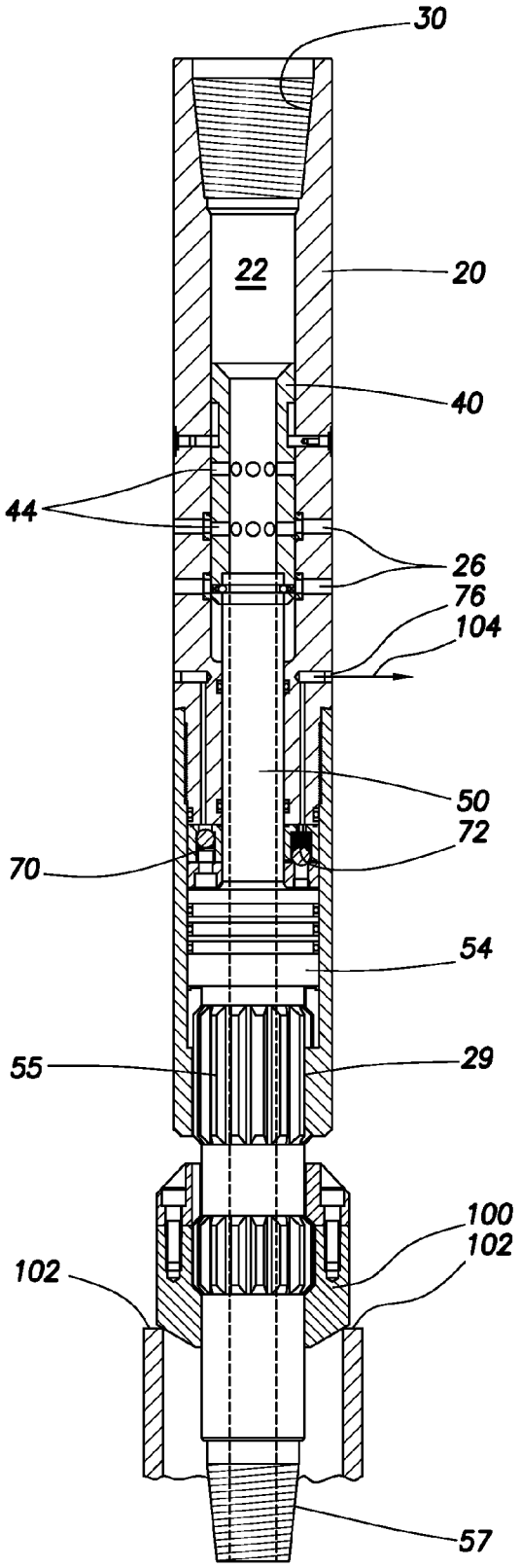
FIG. 2 is a partial section view of the bypass valve of the present inventions in a weight down position (that is, where weight has been set down on the tool, thereby putting the tool in longitudinal compression and shifting the inner mandrel with respect to the main body)
Figure 3:
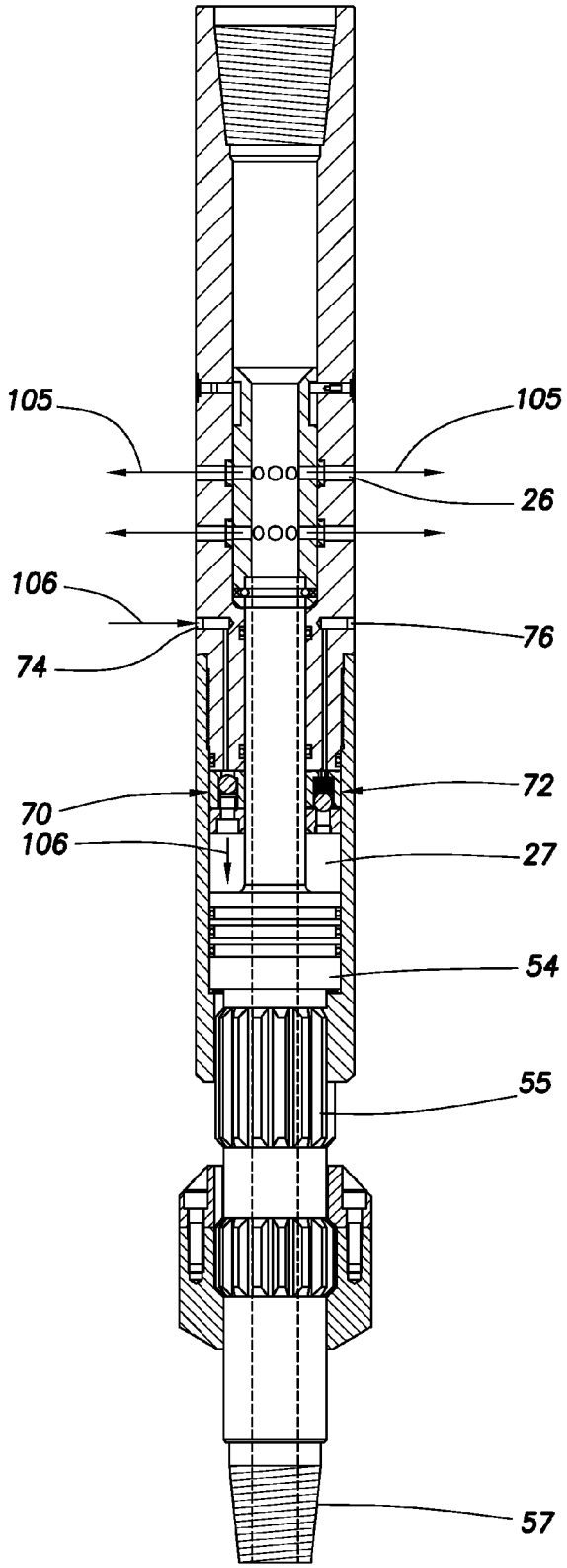
FIG. 3 is a partial section view of the bypass valve of the present inventions in an open or bypass position.

For example, with bypass valve 10 in the closed position (FIG. 1), the tubing string can be placed in a weight down condition with the landing ring 100 supported from a liner top 102 (illustrated in FIG. 2). In this weight down condition, a down hole directed force is applied to bypass valve 10 (and chamber 27B) while the mandrel 50 is held in position. This force causes plunger 54 to compress the fluids in chamber 27. When a sufficient force is reached to cause the pressure in chamber 27 to overcome the springs 79 holding balls 78 against its seat 82, fluid will be discharged from the chamber through fluid passage 76. This in turn will allow bypass valve 10 to move down (telescope) with respect to the plunger 54 and the weight of the tubing string will force upper mandrel section 53 to lift spool 40. As the spool 40 moves axially up (direction of arrow H), index pins 25 will move to the bottom of the notch configuration 43, rotating the spool 22½ degrees. When the string is lifted off the liner top 102, lower body section 20B will be lifted and the weight of the tubing string will force plunger 54 to pump fluid into chamber 27 through passageway 74 and past poppet valve 70. As the lower body section 20B is lifted, the pins 25 will move to the top of the adjacent notch configuration 53, which in turn rotates the spool an additional 22½ degrees, for a total of 45 degrees, which opens the bypass valve 10 to the bypass condition (FIG. 3). The procedure can be repeated to close the bypass valve 10.

Other structural features of bypass valve 10 and how the various parts interact with one another can be described by a description of the operation or function of bypass valve 10 by reference to FIGS. 1-3. In FIG. 1, the bypass valve 10 is illustrated in a closed position, that is, no fluid path or bypass exists from the bore 22 of the valve to the annulus 14. While the tool may be run into a wellbore in either a closed or open position, a process will be described wherein the tool is run into the wellbore in a closed position (as in FIG. 1).

Prior to the tool being run into the wellbore, spool 40 is rotated such that balls 46 are aligned with ports 26 in main body 20. In this position, fluid flow through the ports is blocked, and the tool is therefore "closed." As illustrated, mandrel 50 is in a lowermost position with respect to main body 20. In this position plunger section 54 is at the bottom of chamber 27. As bypass valve 10 is lowered into the wellbore, wellbore fluid is in chamber 27. It is understood that poppet valve 70 can be spring biased to open at a desired pressure to equalize the pressure in chamber 27 and the annulus 14. Fluid in chamber 27 cannot flow from chamber 27 until the telescoping force on the valve and pressure in chamber 27 overcomes the opening pressure/force for poppet valve 72 (which is spring biased to open at a desired pressure). As the string containing the tool is inserted into the well, drag forces on the tool string below the bypass valve 10 may cause the plunger 54 to compress the well fluid in chamber 27; however, by selecting a spring 79 with sufficient bias on the ball 72 to prevent fluid discharge, inadvertent activation of the tool can be avoided. It is understood that mandrel 50 can move longitudinally with respect to main body 20, within structural limits, but mandrel 50 and main body 20 are always rotationally locked by virtue of splines 55 and 28. This feature permits rotating the drill string below bypass valve 10 in either closed or bypass position.

In order to open the bypass valve 10 when down hole, it is necessary to move main body 20 with respect to the mandrel 50, which in turn causes the spool 40 to rotate with respect to upper body section 20A. This movement is created by placing the bypass valve 10 in a weight down position as illustrated in FIG. 2. In FIG. 2, the tubing string has been lowered until landing ring 100 contacts the liner hanger 102. In this position, downward movement of the mandrel 50 is prevented by contact between the ring 100 and hanger 102. Continued lowering of the tubing string places substantial weight down on the tool, causing the upper body 20A to move downward (telescope) with respect to the mandrel 50 which if the weight is sufficient causes plunger 54 to pump the fluid from chamber 47 through poppet valve 72 and out passages 76 as indicated by arrow 104. Downward movement of the upper body section 20A also causes spool 40 to rotate, by virtue of an angled portions (or drum cam surfaces) of indexer slot 42 bearing against indexer pins 25. When the upper body 20A is thereafter lifted or moved upward, the action of the indexer pins 25 and slot 42 completes rotation of the spool 40 to the open position. This combined longitudinal/rotational or "indexing" rotates the open ports in spool 40 into alignment with ports 26 in main body 20.

It can be appreciated that telescoping movement between the mandrel 50 and the main body 20 causes plunger section 54 to pump the fluid in chamber 27 out of chamber 27 through poppet valve 72. As previously mentioned, poppet valve 72 can be preset so as to control the amount of force which must be imposed on mandrel 50 to cause fluid to flow through poppet valve 72. This aspect of bypass valve 10 permits the user to control how much weight must be set down before poppet valve 72 will permit fluid to flow from chamber 27, and thereby permit mandrel 50 to move into main body 20. As previously pointed out, setting the poppet valve 72 to a sufficient level prevents inadvertent activation of the valve during insertion and axial movement in the well.

As mentioned above, after mandrel 50 has been moved upwardly, by setting weight down on bypass valve 10, the drill string must be raised so as to move the main body 20 upward with respect to the mandrel 50, thereby moving spool 40 downwardly so as to align open ports 44 (namely, without balls 46 therein) and 26, and forming the fluid bypass flow path. As can be seen in FIG. 3, the bypass valve 10 has been raised until the mandrel 50 is again at its lowest position. As the bypass valve 10 is raised, well fluids flow into chamber 27 through fluid passages 74 and poppet valve 70 as indicated by arrows 106. Now, spool 40 is also moved into its lowest position, and the flow ports are aligned for bypass flow as indicated by arrows 105.

The bypass valve can be cycled between open and closed positions as many times as desired, by setting weight down on the tool and then picking up. This endless cycling of the valve is accomplished by making the indexer seat 42 endless. In this embodiment, the indexer slot extends continuously circumferentially around the spool 40. It is envisioned that configurations of continuous indexer slots are known in the industry and would enable endless cycling of the valve. Balls 46 in spool 40 are preferably made of carbon chrome steel, and thereby form a metal-to-metal seal in ports 26, enabling the tool cycling to be done under flow conditions, e.g. while fluid bypass is occurring, without cutting out of the hard metal balls or seats. This is in distinction to prior art bypass valves which used resilient seal elements, such as 0-rings, which are highly likely to be cut and destroyed by fluid flow thereby. Replaceable, removable annular seats (see FIGS. 1-3) conform to the spherical valve element, and the ball's movement to the seat accommodates wear and assembly tolerances. As described, the ball is loosely held in the counterbore formed pocket and differential pressure moves the ball up against the seat to seal, like a ball check valve. This loose mounting of the ball accommodates sealing even with misalignment and part wear.

Several novel aspects flow from the structure and operation of the tool. Once the tool has been placed into either the bypass open or closed positions, reciprocation of the drill string and tool can be resumed; this is in contrast to known prior art downhole bypass valves which (once the bypass has been opened) require that the tool be kept in compression to maintain the bypass open, thereby preventing reciprocation of the drill string. As described above in the operational sequence, the bypass can be cycled an unlimited number of times, yielding a repeatable bypass activation system. This repeatable aspect is of key importance should the bypass mechanism be prematurely opened, for example from encountering a downhole obstruction while tripping in the hole, shifting the tool because of high down hole fluid friction forces, etc. The present inventions are capable of handling high pressures, as the metal-to-metal seal in the bypass is not readily deformed or destroyed by high pressures. Finally, the structure of the tool lends it to use with any type of fluid in the wellbore, from solids laden mud to clear brines.

As is well known in the relevant art, high strength metals and metal alloys may be used to fabricate many of the parts of the bypass valve. Seal elements (such as 0-rings or other resilient seals) are provided as necessary to create fluid/pressure seals between components.

While the preceding description contains many specificities, it is to be understood that same are presented only to describe some of the presently preferred embodiments of the inventions, and not by way of limitation. Changes can be made to various aspects of the inventions, without departing from the scope thereof. For example, dimensions and materials can be changed to suit particular situations; the tool can be run in conjunction with other downhole tools; etc. Therefore, the scope of the inventions is not to be limited to the illustrative examples set forth above, but encompasses modifications which may become apparent to those of ordinary skill in the relevant art.

Therefore, the present inventions are well adapted to carry out the objects and attain the ends and advantages mentioned as well as those which are inherent therein. While the inventions have been depicted, described, and are defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A bypass valve apparatus for assembly in a tubing string inserted in a subterranean wellbore wherein the tubing string contains well fluids and forms an annulus between the tubing string and the wellbore, the valve comprising:

an elongated tubular wailed body comprising a main body and mandrel for connection in the tubing string, the mandrel mounted to extend axially into and move axially with respect to the main body, a passageway extending axially through the body;

a bypass passageway extending radially through the wall of the body; and a sleeve valve element mounted in the body to rotate into and out of fluid engagement with the bypass passageway to selectively block and permit flow through passageway whereby well fluids flow into the body flow through the bypass passageway, the sleeve mounted to rotate as the main body and mandrel axially move with respect to each other.

2. The bypass valve of claim 1 additionally comprising a spool mounted in the body for relative movement with respect to the body.

3. The bypass valve of claim 2 additionally comprising a slot and pin engaging the slot, limiting the movement of the spool.

4. The bypass valve of claim 2 wherein the body comprises portions which are axially telescope when axial force is applied to the body.

5. The bypass valve of claim 4 additionally comprising means for moving the spool when the body is axially telescoped.

6. The bypass valve of claim 5 wherein the moving the spool consists of rotating the spool.

7. The bypass valve of claim 5 wherein the moving the spool consists of axially moving the spool.

8. The bypass valve of claim 5 wherein the moving the spool comprises rotating and axially moving the spool.

9. The bypass valve of claim 5 wherein the means for moving comprises a slot and pin engaging the slot.

10. The bypass valve of claim 4 additionally comprising a trigger selectively preventing and permitting telescoping.

11. The bypass valve of claim 10 wherein the trigger permits telescoping only when the axial force exceeds a set amount.

12. The bypass valve of claim 11 wherein the set amount of force can be varied.

13. A bypass valve apparatus for assembly in a tubing inserted in a subterranean wellbore wherein the tubing string contains well fluids and forms an annulus between the tubing string and the wellbore, the valve comprising:

an elongated tubular walled body for connection in the tubing string, a passageway extending axially through the body;

a bypass passageway extending radially through the wall of the body; and a valve element repeatedly movable into and out of engagement with the passageway to selectively block and permit flow through the passageway, whereby well fluids flowing into the body will flow through the bypass passageway;

a spool mounted the body for relative movement with respect to the body;

the valve element comprises a ball-shaped valve element operably associated with the spool and moved by the spool into and out of engagement with the passageway.

14. The bypass valve of claim 13 wherein the spool is mounted for rotational movement with respect to the body.

15. The bypass valve of claim 13 wherein the ball valve element comprises hardened material.

16. The bypass valve of claim 13 wherein the ball valve comprises metallic material.

17. A bypass valve apparatus for assembly in a tubing string, inserted in a subterranean wellbore, wherein the tubing string contains well fluids and forms an annulus between the tubing string and the wellbore, the valve comprising:

an elongated tubular walled body for connection in the tubing string, a passageway extending axially through the body;

a bypass passageway, extending radially through the wall of the body;

a valve element repeatedly movable into and out of engagement with the passageway to selectively block and permit flow through the passageway, whereby well fluids flow into the body flow through the bypass passageway; and a spool mounted in the body for relative movement with respect to the body;

comprising a slot and pin engaging the slot, limiting the movement of the spool and, wherein the slot is located on the exterior of the spool, and the pin is connected to the body.

18. The bypass valve of claim 17 wherein the slot is endless.

19. A method of using a valve to selectively provide bypass flow in a well containing tubing string inserted in a subterranean hydrocarbon wellbore wherein the tubing string contains well fluids and forms an annulus between the tubing string and the wellbore, comprising the steps of:

providing a valve with a body comprising a main body and a mandrel, each separately connected to the tubing string, the main body and mandrel axially telescope with respect to each other to open and close a bypass port in the body upon actuation of a force valve in a trigger;

setting the force valve of the trigger for selectively permitting and preventing telescoping of the valve body;

assembling the valve in a tubing string;

inserting the tubing string and valve to a subterranean location in the wellbore without telescoping the valve body;

providing sufficient telescoping force on the body to telescope the body and open the bypass port to provide bypass flow; and thereafter, providing sufficient telescoping force to the body to telescope the body and close the bypass port.

20. The method of claim 19 comprising the additional step of repeatedly applying sufficient telescoping force to the body to repeatedly open and close the bypass port.

21. The method of claim 19, wherein the step of providing telescoping force comprises placing the tubing string in a weight down condition.

* * * * *